US005895600A

United States Patent [19]

Lee

[11] Patent Number: 5,895,600

[45] Date of Patent: Apr. 20, 1999

[54] ELECTRONIC CONTROL TIMER FOR A MICROWAVE OVEN

[75] Inventor: Geon-Gook Lee, Kwang-Ju, Rep. of Korea

[73] Assignee: Daewoo Electronics Co., Ltd., Seoul, Rep. of Korea

[21] Appl. No.: 08/657,081

[22] Filed: Jun. 3, 1996

[30] Foreign Application Priority Data

Jul. 19, 1995 [KR] Rep. of Korea ..... 95-21142

[51] Int. Cl.[6] ..... H05B 6/68

[52] U.S. Cl. ..... 219/719; 200/38 FA; 219/702; 368/10

[58] Field of Search ..... 219/719, 702, 219/720; 200/38 F, 38 FA, 27 B; 368/10

[56] References Cited

U.S. PATENT DOCUMENTS

| | | | |
|---|---|---|---|
| 4,287,583 | 9/1981 | Strachan et al. | 368/10 |
| 4,420,669 | 12/1983 | Scalf et al. | 219/719 |
| 4,523,062 | 6/1985 | Mahon | 200/38 R |
| 4,600,826 | 7/1986 | Ishimura | 219/492 |
| 5,097,105 | 3/1992 | Boin et al. | 219/719 |
| 5,107,088 | 4/1992 | Aoki | 219/719 |
| 5,134,262 | 7/1992 | Lee | 219/719 |

*Primary Examiner*—Philip H. Leung
*Attorney, Agent, or Firm*—Pillsbury Madison & Sutro LLP

[57] ABSTRACT

An electronic control timer of microwave oven capable of establishing a total cooking period by different time units is disclosed. The electronic control timer includes a gear having a first gear segment and a second gear segment. A switch installed adjacently to the gear generates a pulse signal in accordance with a rotation displacement of the gear. The gear driving device is activated when the switch is activated, and then rotates the gear in an opposite direction to an initial rotating directioon of the gear and returns the gear to an initial state thereof. The first gear segment includes a first gear teeth having a first gear pitch corresponding to a first time unit and a second gear teeth having a second gear pitch corresponding to a second time unit. The second gear segment has a toothless shape. The switch is activated when it is brought into contact with the first gear segment so that the switch generates the pulse signal. And, the switch is not activated when it is brought into contact with the second gear segment.

18 Claims, 7 Drawing Sheets

ELECTRONIC CONTROL TIMER FOR A MICROWAVE OVEN

BACKGROUND OF THE INVENTION

1. Field of the Invention

The present invention relates to an electronic control timer for a microwave oven, and more particularly to an electronic control timer for a microwave oven which is capable of setting a total cooking period by various time units, has a simple internal structure and can be manufactured at a low cost.

2. Description of the Prior Art

Various types of some microwave ovens having an automatic cooking function are well known in the art. FIG. 8 is a view for illustrating a conventional microwave oven 10. Generally, microwave oven 10 includes a microprocessor 20 for controlling the operation of microwave oven 10, a power supply unit 30 and a magnetron 40 for generating microwaves. Further, microwave oven 10 includes an in-flow air temperature sensor 60*a*, an out-flow air temperature sensor 60*b*, a weight sensing sensor 60*c*, an in-flow air temperature sensing circuit 62*a*, an out-flow air temperature sensing circuit 62*b*, weight sensing circuit 62*c*, first, second and third analog/digital converters 64*a*, 64*b* and 64*b*, a cooking chamber 70, a turntable 72, a turntable motor 74 for rotating turntable 72, a cooling fan 80*a*, a blasting fan 80*b*, a cooling fan motor 82*a* and a blasting fan motor 82*b*.

FIG. 9 is a perspective view of the microwave oven 10 having the above structure. Microwave oven 10 includes a housing 12 having an opening at the front thereof, a door 14 and an operation panel 50. Door 14 is pivotally mounted to one side end of the housing 12 in order to close the front opening of the housing 12. Operation panel 50 is positioned at the right front portion of housing 12. Operation panel 50 includes a cooking function selection switch 52 and a timer 54. Cooking function selection switch 52 controls the output of microwaves for heating and cooking food within cooking chamber 70 of microwave oven 10. Timer 54 sets the cooking period of the food. On operation panel 50, a symbol for selecting the cooking function which corresponds to the amount of microwaves being output is displayed around cooking function selection switch 52. The cooking period which can be set is displayed around timer 54. A door switch 56 for opening and closing the door 14 is positioned below the timer 54.

Hereinbelow, the operation of conventional microwave oven 10 will be described with reference to FIGS. 8 and 9 in detail.

The food to be cooked is first inserted into cooking chamber 70. When a user simultaneously sets the cooking period by means of timer 54 and the cooking function by means of selection switch 52, an electric signal corresponding to the numerical value established by timer 54 and selection switch 52 is sent to microprocessor 20. Based on the electric signal, microprocessor 20 operates power supply unit 30.

Power supply unit 30 simultaneously supplys electric power to magnetron 40, turntable motor 74, cooling fan motor 82*a* and blasting fan motor 82*b*. When the electric power is supplied from power supply unit 30, magnetron 40 generates microwaves for cooking the food. Cooling fan motor 82*a* actuates cooling fan 80*a* for cooling magnetron 40 so that cooling fan 80*a* aircools magnetron 40. Also, blasting fan motor 82*b* actuates blasting fan 80*b* for introducing the air into cooking chamber 70 so that blasting fan 80*b* blows the air into cooking chamber 70. As a result, the air temperature in cooking chamber 70 can be constantly maintained. Further, turntable motor 74 rotates turntable 72 on which the food to be cooked has been put so it is cooked uniformly.

Meantime, when the temperature equilibrium in cooking chamber 70 is established after the predetermined cooking period has elapsed, in-flow air temperature sensor 60*a* and out-flow air temperature sensor 60*b* which are respectively mounted on an inlet 84*a* and an outlet 84*b* of cooking chamber 70 detect the temperatures of the air and generate temperature sensing signals. The temperature sensing signals which have been generated from in-flow air temperature sensor 60*a* and out-flow air temperature sensor 60*b* are sent to first and second analog/digital converter 64*a* and 64*b* via in-flow air temperature sensing circuit 62*a* and out-flow air temperature sensing circuit 62*b*. First and second analog/digital converters 64*a* and 64*b* convert the analog signals which are the temperature sensing signals into digital signals, and send the digital signals to microprocessor 20. Then, microprocessor 20 decides the temperature increment of cooking chamber 70 based on the temperature sensed by in-flow air temperature sensor 60*a* and out-flow air temperature sensor 60*b*.

Meanwhile, weight sensing sensor 60*c* which is diposed below the outside bottom surface of cooking chamber 70 senses the weight of the food after the predetermined cooking period has elapsed and generates a weight sensing signal. The weight sensing signal as generated above is sent to third analog/digital converter 64*c* via weight sensing circuit 62*c*. Third analog/digital converter 64*c* converts an analog signal which is the weight sensing signal into a digital signal, and sends the digital signal to microprocessor 20. Microprocessor 20 determines the most suitable cooking state based on the weight sensing signal. That is, microprocessor 20 determines the appropriate heating time by discriminating the change in weight depending on the progress of the cooking period, and controls magnetron 40 on this basis.

In the conventional microwave oven 10 which operates as above, timer 54 for setting the cooking period has a mechanical structure capable of setting the cooking period based on the rotating angular of a timer knob.

Generally, timer 54 is designed so as to set the cooking period in such a manner that timer 54 can define the cooking period by using a time unit of one minute in relation to a cooking period of zero to ten minutes and a time unit of five minutes in relation to a cooking period of ten to thirtyfive minutes. Therefore, timer 54 has the mechanical structure for controlling a first timing section corresponding to the cooking period of zero to ten minutes and a second timing section corresponding to the cooking period of ten to thirtyfive minutes. In order to control the first and second timing sections, it is necessary to have a plurality of gears and a plurality of synchro-motors for rotating the gears. Further, it is necessary to have a control device for controlling the gears and the synchro-motors, and a plurality of electric wires for electrically connecting the gears with synchro-motors. Therefore, conventional timer 54 has a complicated internal structure. As a result, a manufacturing procedure of timer 54 can be complicated, and the manufacturing cost of timer 54 increases.

U.S. Pat. No. 5,107,088 issued to Masayuki Aoki on Apr. 21, 1992 discloses a timer capable of setting the cooking period and cooking start by use of a single timer knob.

FIGS. 10 and 11 illustrate Masayuki Aoki's timer 54*a*. Timer 54*a* includes a timer knob 102, a switch case 106, a switch shaft 108, a contact disc 110 and a switch substrate 112. Timer knob 102 and switch case 106 are mounted on an operation panel 50*a* by a nut 104. Switch shaft 108 is rotatably mounted on switch case 106. One end of switch shaft 108 is outwardly projected through operational panel 50*a*. Timer knob 102 is coupled with one end of switch shaft 108 so as to be rotated therewith. A contact arm 120 having first, second and third contacts 120*a*, 120*b* and 120*c* and a switch substrate 112 having a printed circuit board are attached to switch case 106.

Switch substrate 112 has a common conductive pattern 124, a first conductive pattern 126 and a second conductive pattern 128 which concentrically printed on one surface thereof. A plurality of scan points or pulse generating conductors 126*a* are printed at the inner periphery of the first conductive pattern 126 at equal pitches. Also, a plurality of scan points or pulse generating conductors 128*a* are printed on the outer periphery of the second conductive pattern 128 at the same pitch as pulse generating conductors 126*a*. Pulse generating conductors 128*a* are shifted slightly relative to pulse generating conductors 126*a* in a clockwise direction.

A plurality of groove-like contact stops 118 are formed on switch substrate 112. On switch substrate 112, contact stops 118 are radially formed in order to be positioned between one of pulse generating conductors 126*a* and an adjacent one thereof and between one of pulse generating conductor 128*a* and an adjacent one thereof. First, second and third contacts 120*a*, 120*b* and 120*c* of contact arm 120 are positioned on one of contact stops 118. First contact 120*a* is brought into contact with common conductive pattern 124. Second contact 120*b* is brought into contact with a portion of a surface of switch substrate 112*a* between pulse generating conductors 126*a*. Also, third contact 120*c* is brought into contact with a portion of the surface of the switch substrate 112*a* between pulse generating conductors 128*a*. First, second and third lead terminals 114, 116 and 118 on switch substrates 112 are electrically connected to common conductive patterns 124, first conductive patterns 126 and second conductive patterns 128, respectively.

Hereinbelow, the operation of timer 54*a* having the above structure will be described.

If a user rotates timer knob 102 in a clockwise direction, first, second and third contacts 120*a*, 120*b* and 120*c* of contact arm 120 are moved in a clockwise direction from at an original position of contact stop 130 to a following position of contact stop 130. First and second contacts 120*a* and 120*b* are brought into contact with pulse generating conducts 126*a* and 28*a* during the movement of contact arm 120. Such contact operations of first and second contacts 126*a* and 128*b* generate pulse signals. The number of pulses of the individual pulse signal depends on the rotating angle of timer knob 102. Microprocessor 20 judges the amount of angular displacement of timer knob 102 in a clockwise direction based on the generated pulse signals, and determines the setting period of timer 54*a*. That is, microprocessor 20 determines the setting period of timer 54*a* based on the displacement of contact arm 120 according to the rotation of timer knob 102.

On the other hand, if the user rotates timer knob 102 in a counter-clockwise direction, pulse signals are generated based on an operational principle such as the user rotating timer knob 102 in a clockwise direction. Microprocessor 20 determines the setting period of timer 54*a* based on the displacement of contact arm 120 according to the rotation of timer knob 102 in the same manner that the user rotates timer knob 102 in a clockwise direction.

As described above, Masayuki Aoki's timer 54*a* determines the setting period of the timing sections based on the rotating direction of timer knob 102 and pulse signals generated by contacting the electric contacts with the conductive patterns. That is, timer 54*a* is capable of setting the cooking period and performing a cooking start by using single timer knob 102. However, Masayuki Aoki's timer 54*a* has a plurality of complicated conduct patterns on switch substrate 112 and a plurality of internal wires for adding the cooking start function. Consequently, the Masayuki Aoki's timer 54*a* is disadvantageous in that the internal structure is complicated and the manufacturing cost is high.

SUMMARY OF THE INVENTION

The present invention is contrived to solve the foregoing problems. It is an object of the present invention to provide an electronic control timer for a microwave oven, which is capable of setting a total cooking period by various time units, has a simple internal structure and a low manufacturing cost.

In order to achieve the above object, the present invention provides an electronic control timer for a microwave oven, the electronic control timer comprising:

- a gear having a first gear segment and a second gear segment which are continuously formed at a periphery of the gear in order to receive a driving force and to recover an initial state;
- a switch for generating a pulse signal in accordance with a rotation displacement of the gear, the switch being installed adjacently to the gear, being activated during a total cooking period and not being activated when the total cooking period is ended; and
- a gear driving means for generating the driving force, the gear driving means being activated to generate the driving force when the switch is activated.

The first gear segment includes a plurality of teeth having first and second gear teeth, and the second gear segment has a toothless shape. The first gear teeth has a first gear pitch corresponding to a first time unit and a second gear pitch corresponding to a second time unit. The first gear pitch and the second gear pitch are different from each other.

In a first preferred embodiment according to the present invention, the switch is brought into contact with the first gear segment during the total cooking period and is brought into contact with the second gear segment when the total cooking period is ended.

Preferably, the switch is a micro switch having a snap action mechanism.

The gear driving means is electrically connected to the switch, and includes a U-laid-shaped core, a coil which is wound around the core and a circular rotator which is disposed to a central region of an opening of the core. The rotator includes a circular head, a permanent magnet which is installed to a central region of the head, a plurality of rotating members which are installed to a periphery of the head in a symetrical manner in order to be engaged with the first gear segment, and an extension which is downwardly extended from the central region of the head. The core and the coil are activated by the pulse signal which is transmitted from the switch when the switch is activated so that the core and the coil form an electro magnet, the rotator is rotated by an electromagnetic interaction between the rotator and the electro magnet, and the rotating members are rotated in an opposite direction to an initial rotating direction of the gear in accordance with the rotation of the rotator, are engaged with the first gear segment, gradually rotate the gear in the opposite direction and return the gear to the initial state.

The extension is inserted into a rotator receiving portion formed at a timer panel of the microwave oven, and the extension includes a plurality of reverse rotation preventing teeth for preventing a rotating of the rotator in the opposite direction. The rotator receiving portion includes a protrusion which is engaged with the reverse rotation preventing teeth and an elastic member for elastically supporting the protrusion. The reverse rotation preventing teeth are formed at a periphery of the extension, and sharply protrude in the opposite direction.

Further, in a second preferred embodiment according to the present invention, different from the first embodiment in which the switch generates the pulse signal by contacting with the first gear segment, the present invention provides an electronic control timer for a microwave oven, besides the above gear driving means, the electronic control timer comprising:

a first arc section and a second arc section for setting the total cooking period, and a switch for generating a pulse signal, the switch is activated by contacting with the first arc section during the total cooking period and not activated by contacting with the second arc section when the total cooking period is ended.

The first arc section includes a prominence-and-depression-shaped conductive pattern and the second arc section has a patternless shape. The first arc section and the second arc section are continuously formed on an side of the gear so that the first arc section and the second arc section radially correspond to the first gear segment and the second gear segment, respectively.

As described above, in the electronic control timer according to the first preferred embodiment of the present invention, the switch is activated when it is brought into contact with the first gear segment continuously formed the periphery of the gear so that the switch generates the pulse signal. The switch is not activated when it is brought into contact with the second gear segment. The gear driving device electrically connected to the switch rotates the gear in the opposite direction to the initial rotating direction and returns the gear to the initial state thereof. On the other hand, in the electronic control timer according to the preferred second embodiment of the present invention, the switch is activated when it is brought into contact with the first arc section continuously formed on the upper side of the gear so that the switch generates the pulse signal. The switch is not activated when it is brought into contact with the second arc section. The electronic control timer of the present invention having the above structure is capable of setting a total cooking period by various time units, has a simple internal structure and a low manufacturing cost.

BRIEF DESCRIPTION OF THE DRAWINGS

The above objects and other advantages of the present invention will become more apparent by describing in detail preferred embodiments thereof with reference to the attached drawings, in which.

DESCRIPTION OF THE PREFERRED EMBODIMENTS

Hereinbelow, the preferred embodiments of the present invention will be described with reference to the accompanying drawings in detail.

Figure 1:
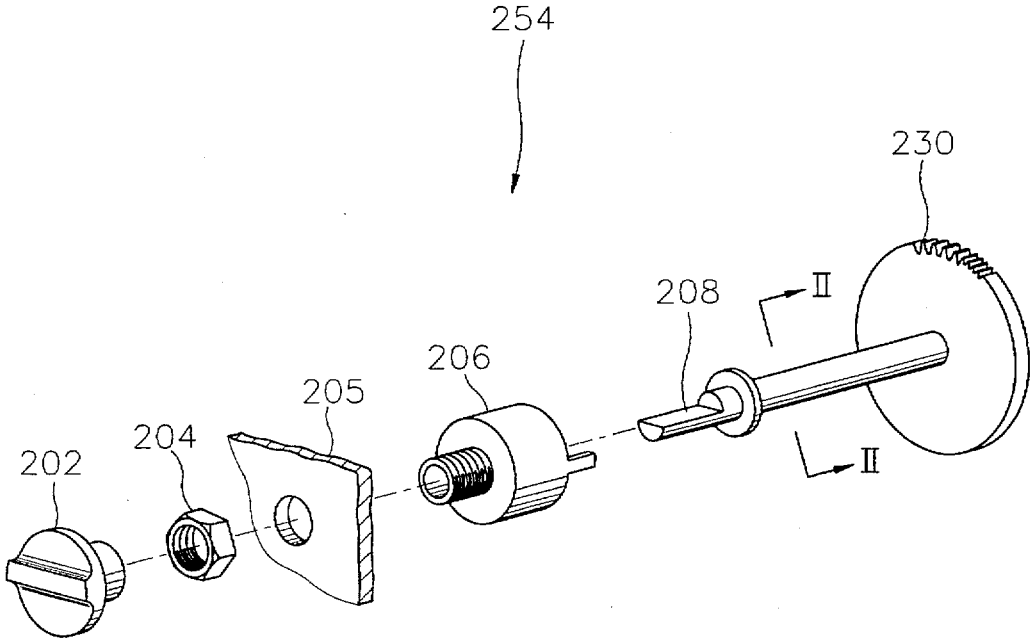
FIG. 1 is an exploded perspective view of an electronic control timer according to a first embodiment of the present invention.

FIG. 1 illustrates an electronic control timer 254 according to a first embodiment of the present invention. Electronic control timer 254 includes a timer knob 202, a switch case 206, a switch shaft 208 and a gear 230. Timer knob 202 and switch case 206 are mounted on an operation panel 205 by a nut 204. Switch shaft 208 is rotatably mounted on switch case 206. One end of switch shaft 208 is outwardly projected through operation panel 205. Timer knob 202 is coupled with one end of switch shaft 208 so as to be rotated therewith. The other end of switch shaft 208 is attached to the center portion of gear 230.

Figure 2:
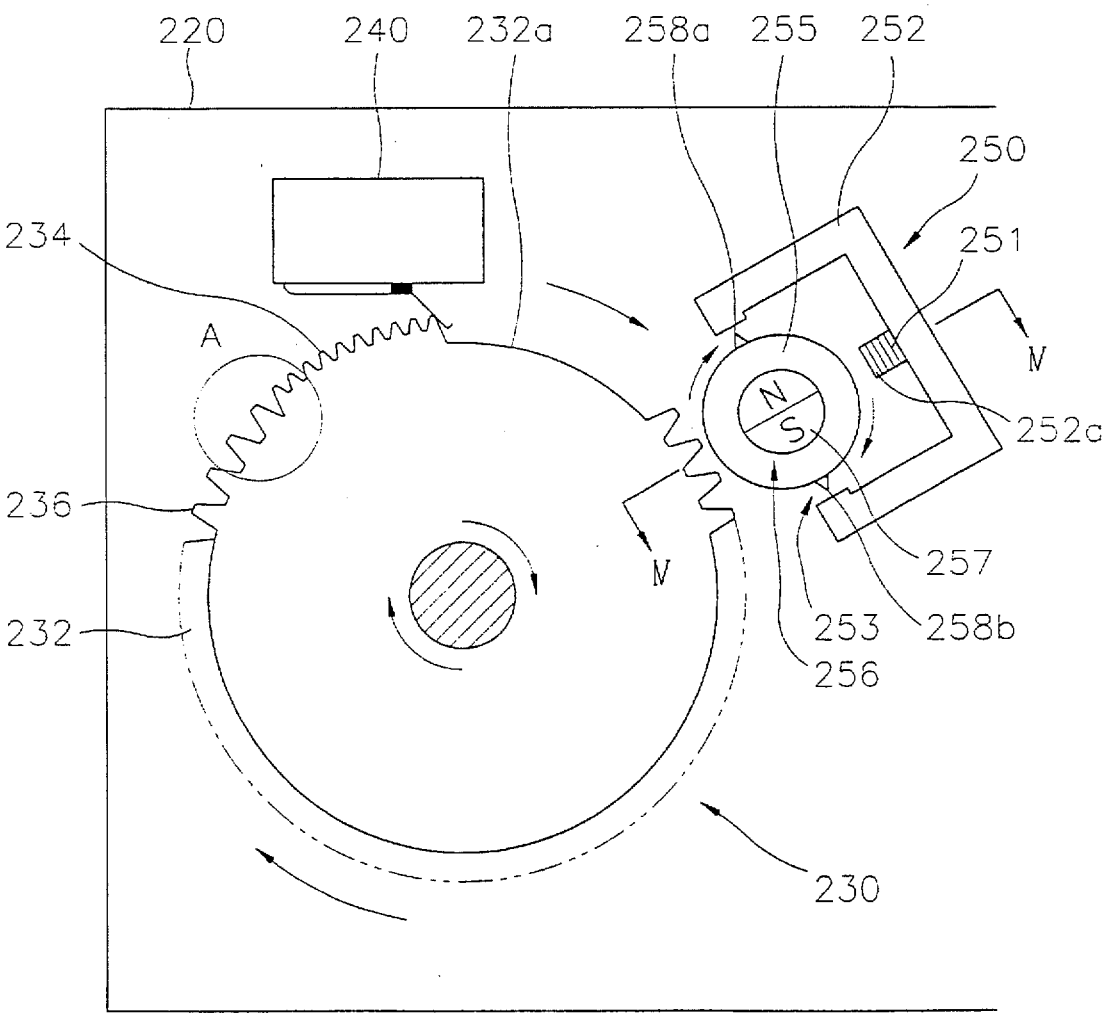
FIG. 2 is a sectional detailed view taken along line II—II of FIG. 1.

FIG. 2 is a view for illustrating gear 230 in more detail and the adjacent components of electronic control timer 254. Electronic control timer 254 includes a circular single gear 230, a switch 240 which is adjacently installed to gear 230 and a gear driving device 250. Gear 230, switch 240 and gear driving device 250 are mounted on a timer panel 220.

Gear 230 includes a first gear segment 232 and a second gear segment **232*a* which are formed at the outer periphery of gear 230 for setting a total cooking period by various time units. First gear segment 232 includes first gear teeth 234 and second gear teeth 236. Second gear segment 232*a* has a toothless shape. First gear teeth 234 and second gear teeth 236 have different gear pitches so that variable pulses corresponding to the various time unit may be generated. In other words, first gear teeth 234 and second gear teeth 236 have the different gear pitches in order to generate the variable pulses in accordance with the rotation displacement of gear 230. Therefore, first gear teeth 234 and second gear teeth 236 have different pitch circles, and generate the variable pulses when first gear teeth 234 and second gear teeth 236 are brought into contact with switch 240 in consequence of the rotation of gear 230**.

Figure 3:
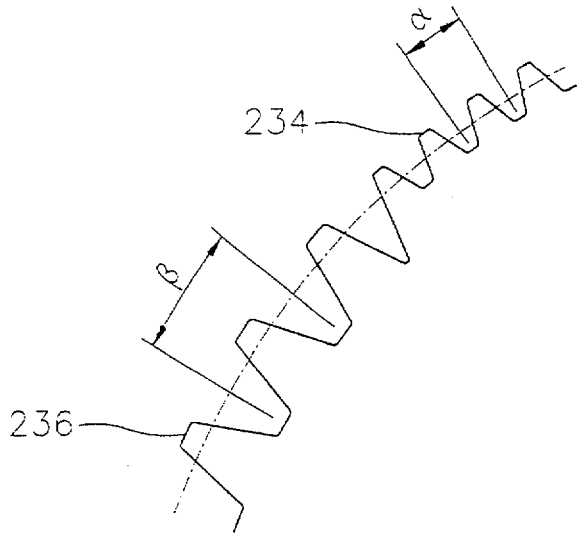
FIG. 3 is an extended view of a section A shown in FIG. 2.

FIG. 3 is an extended view of a portion of gear teeth composed of first gear teeth 234 and second gear teeth 236. First gear teeth 234 have a first gear pitch $\alpha$ for determining a timing speed section of a first time unit set by timer knob 102. Second gear teeth 236 have a second gear pitch $\beta$ for determining a timing speed section of a second time unit set by timer knob 102. Accordingly, the second gear pitch $\beta$ is larger than the first gear pitch $\alpha$. Therefore, the second time unit corresponding to the second gear pitch $\beta$ is longer than the first time unit corresponding to the first gear pitch $\alpha$. Preferably, the first time unit is one minute and the second time unit is five minutes. The time unit set by timer knob 102 can be changed appropriately, as necessary.

Switch 240 is installed to the final position of first gear segment 232 in order to cover the total cooking period which can be set by timer knob 102. Switch 240 is activated by contacting with first gear segment 232 during the total cooking period. In other words, switch 240 generates a pulse train by contacting with first gear teeth 234 and second gear teeth 236 which are continuously formed at a periphery of gear 230. The pulse train has a plurality of pulses. Switch 240 is maintained in a non-activated state by contacting with second gear segment 232*a* at the expiration of the total cooking period set by timer knob 102. Preferably, switch 240 is a micro-switch having a snap action mechanism.

Gear driving device 250 for rotating gear 230 is electrically connected to switch 240. Gear driving device 250 is activated when switch 240 is activated. Thereby, gear driving device 250 produces a driving force. To achieve this, gear driving device 250 includes a U-laid letter-shaped core 252, a coil 254 and a circular rotator 254. Coil 254 is wound around a protrusion 252*a* which protrudes toward a central region from the left side of core 252. Rotator 254 is disposed at a central region of an opening 253 of core 252. Rotator 254 includes a circular head 255, a permanent magnet 257, an extension 259 and a plurality of rotating members 258*a* and 258*b*. Permanent magnet 257 is installed at a central region of head 255. Extension 259 is downwardly extended from the central region of head 255. Rotating member 258*a* and 258*b* are installed to a periphery of head 255 in a symetrical manner. Rotating member 258*a* and 258*b* engage with first gear teeth 234 or second gear teeth 236.

Figure 4:
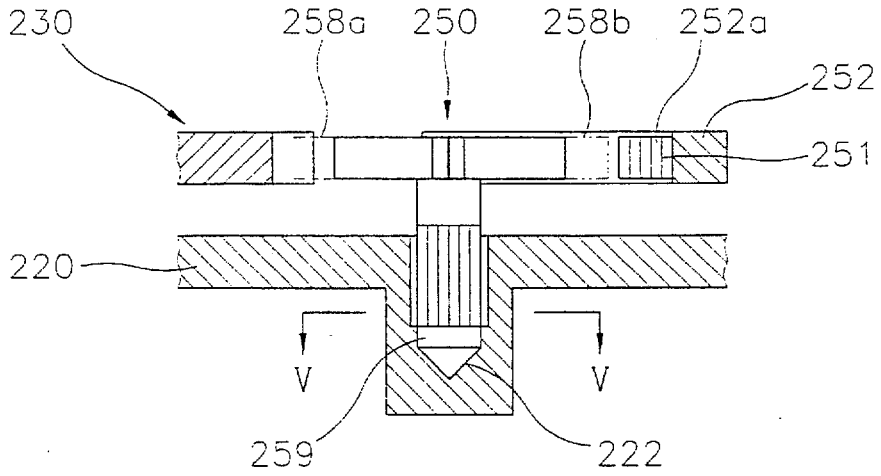
FIG. 4 is a sectional view taken along line IV—IV of FIG. 2.
Figure 5:
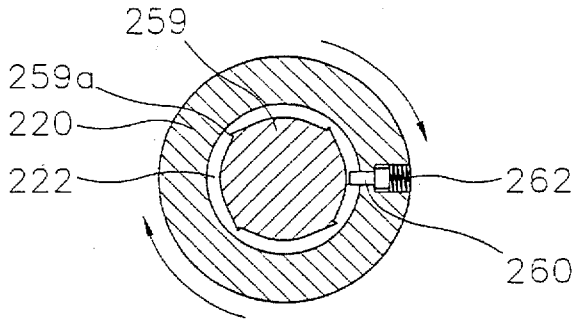
FIG. 5 is a sectional view taken along line V—V of FIG. 4.

FIGS. 4 and 5 illustrate the structure of rotator 256 in detail. Extension 259 of rotator 256 is inserted into a rotator receiving portion 222 formed at timer panel 220. A plurality of reverse rotation preventing teeth 259*a* for preventing the reverse rotation of rotator 256 are formed at a periphery of extension 259. Preferably, reverse rotation preventing teeth 259*a* sharply protrudes in a counter-clockwise direction in order to prevent the rotation of rotator 256 in a counter-clockwise direction, which rotates in a clockwise direction. Further, a protuberance 260 which is capable of engaging with reverse rotation preventing teeth 259*a* is formed in rotator receiving portion 222. Protuberance 260 is supported by an elastic member 262 which is inserted and fixed in timer panel 222.

Hereinbelow, the operation of electronic control timer 254 according to the first embodiment of the present invention will be described.

Referring to FIGS. 1 and 2, at first, the food to be cooked is placed in the cooking chamber of the microwave oven, then the user sets the cooking period by rotating timer knob 102. That is, if the user rotates timer knob 102 in a clockwise direction based on a notch mark on operation panel 205, gear 230 connected to timer knob 102 via switch shaft 208 is rotated in a clockwise direction.

For example, when the user rotates timer knob 102 so that the total cooking period is fifteen minutes, switch 240 adjacent to gear 230 is brought into contact with second gear teeth 236 via first gear teeth 234. In other words, switch 240 is brought into contact with second gear teeth 236 having a cooking time unit of five minute via first gear teeth 234 having a cooking time unit of one minute. Switch 240 generates pulse signals corresponding to the total cooking period having fifteen minutes by contacting with first gear teeth 234 and second gear teeth 236.

The pulse signals generated from switch 240 are transmitted to a microprocessor (not shown) and gear driving device 250. The microprocessor operates the microwave oven based on the pulse signals transmitted from switch 240. Meanwhile, if pulse signals are transmitted to gear driving device 250 electrically connected to switch 240, gear driving device 250 rotates gear 230 in a counter-clockwise direction and gradually returns gear 230 to the initial state thereof in accordance with the time lapse of the cooking period.

The operations of gear driving device 250 will be described in more detail. If pulse signals corresponding to the cooking period having fifteen minutes are supplied to gear driving device 250 from switch 240, a current having a certain flow direction flows to coil 254 which is wound around protrusion 252*a* of core 252. As a result, protrusion 252*a* of core 252 and coil 254 is electrically magnetized. At this time, the electromagnet composed of protrusion 252*a* of core 252 and coil 254, and permanent magnet 257 which is inserted into the central region of rotator 256 generate an attractive force and a repulsive force by mutual interaction therebetween. Accordingly, rotator 256 is rotated in a counter-clockwise direction, and alternately engages with first gear teeth 234 and second gear teeth 236 which are rotated in a clockwise direction. Thereby, rotating members 258*a* and 258*b* rotate gear 230 in a counter-clockwise direction which is an opposite direction to the initial rotating direction. Therefore, gear 230 gradually is rotated in a counter-clockwise direction in accordance with the time lapse of the cooking period having fifteen minutes.

When the cooking period having fifteen minutes set by timer knob 102 has lapsed, switch 240 is brought into contact with second gear segment 232*a* of gear 230. As a result, switch 240 is not activated and does not generate the pulse signals. Thus, gear 230 returns to the initial state thereof. Further, since the pulse signals are not supplied to the microprocessor, the microwave oven is not operated.

If the user rotates timer knob 102 so that the total cooking period is a predetermined time less than ten minutes, switch 240 is brought into contact with first gear teeth 234 having the cooking time unit of one minute. Switch 240 generates pulse signals corresponding to the predetermined time unit less than ten minutes by contacting with first gear teeth 234. The pulse signals generated from switch 240 is transmitted to the microprocessor and gear driving device 250. The microprocessor operates microwave oven 100 based on the pulse signals supplied from switch 240. On the other hand, when the pulse signals are transmitted to gear driving device 250 electrically connected to switch 240, gear driving device 250 gradually rotates gear 230 and gradually returns gear 230 to the initial state thereof in accordance with the time lapse of the cooking period. The operation of gear driving device 250 for returning the gear 230 to the initial state is the same as the above example wherein the total cooking time is fifteen minutes. Therefore, detailed descriptions will be omitted.

Figure 6:
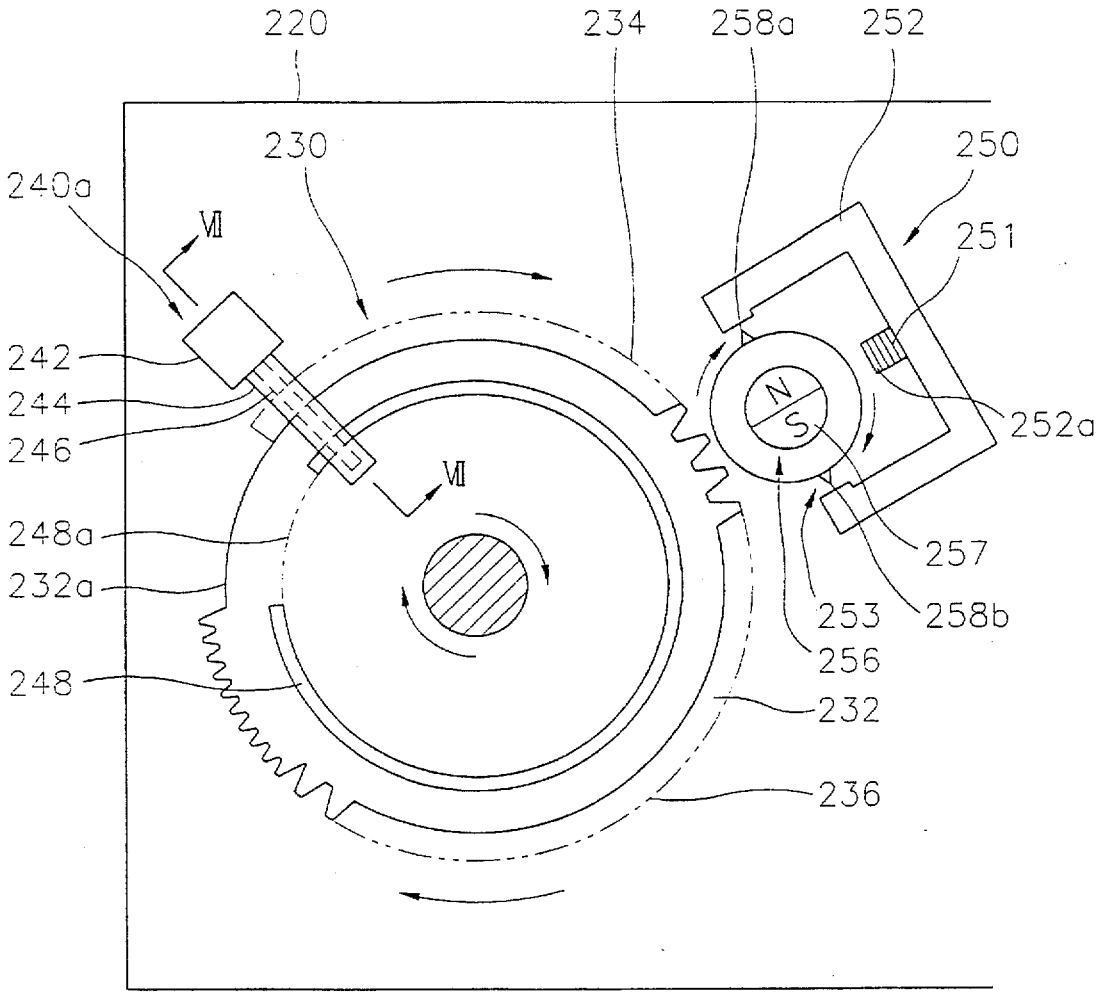
FIG. 6 is a view for showing an internal structure of the electronic control timer according to a second embodiment of the present invention.

FIG. 6 illustrates an internal structure of an electronic control timer according to a second embodiment of the present invention. As described above, in the first embodiment according to the present invention, switch 240 is engaged with first gear teeth 234 and second gear teeth 236 to generate the pulse signals. In the meantime, in the second embodiment according to the present invention, a switch 240*a* having an internal structure different from that of switch 240 is brought into contact with a first arc section 248 formed on an upper side of gear 230 to generate the pulse signals.

According to the second embodiment of the present invention, a first arc section 248 having a prominence-and-depression-shaped conductive pattern and a second arc section 248*a* are continuously formed on a side surface of gear 230. First arc section 248 is formed in a circular shape on the side surface of gear 230 in order to correspond to first gear segment 232 formed at the outer periphery of gear 230. First arc section 248 corresponds to the total cooking period which can be set by timer knob 102.

Figure 7:
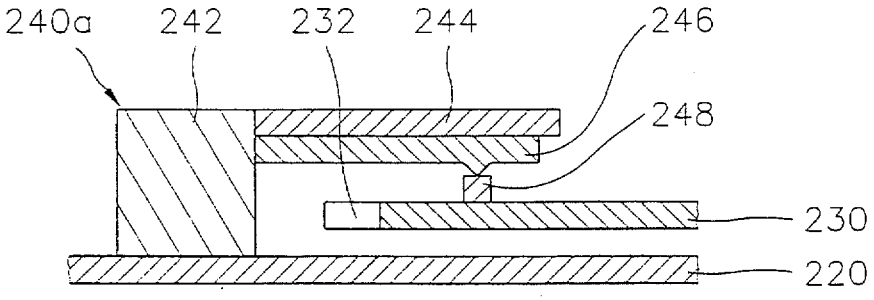
FIG. 7 is a sectional view taken along line VII—VII of FIG. 6.
Figure 8:
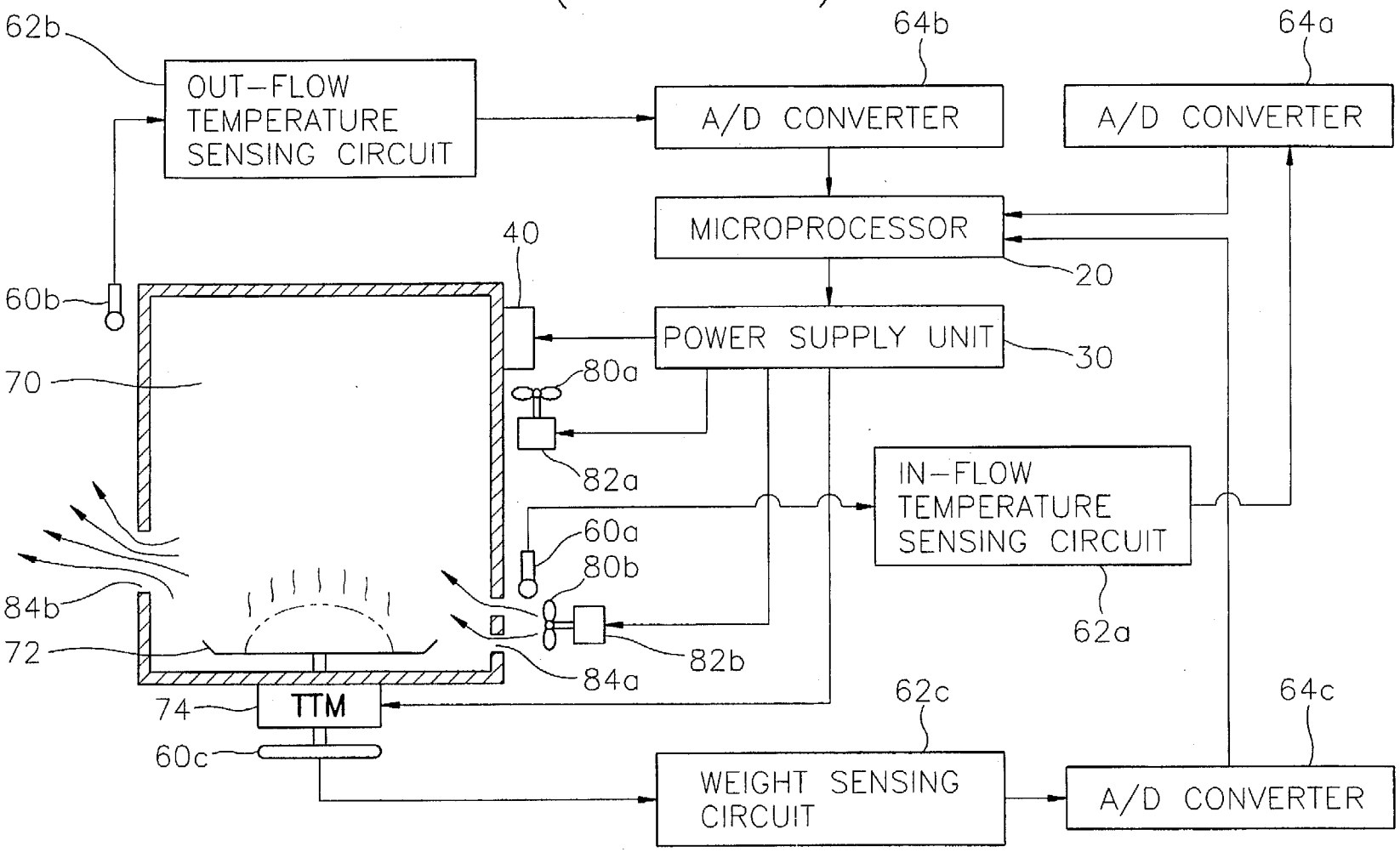
FIG. 8 (PRIOR ART)
FIG. 8 is a block diagram for showing an operation of a conventional microwave oven.
Figure 9:
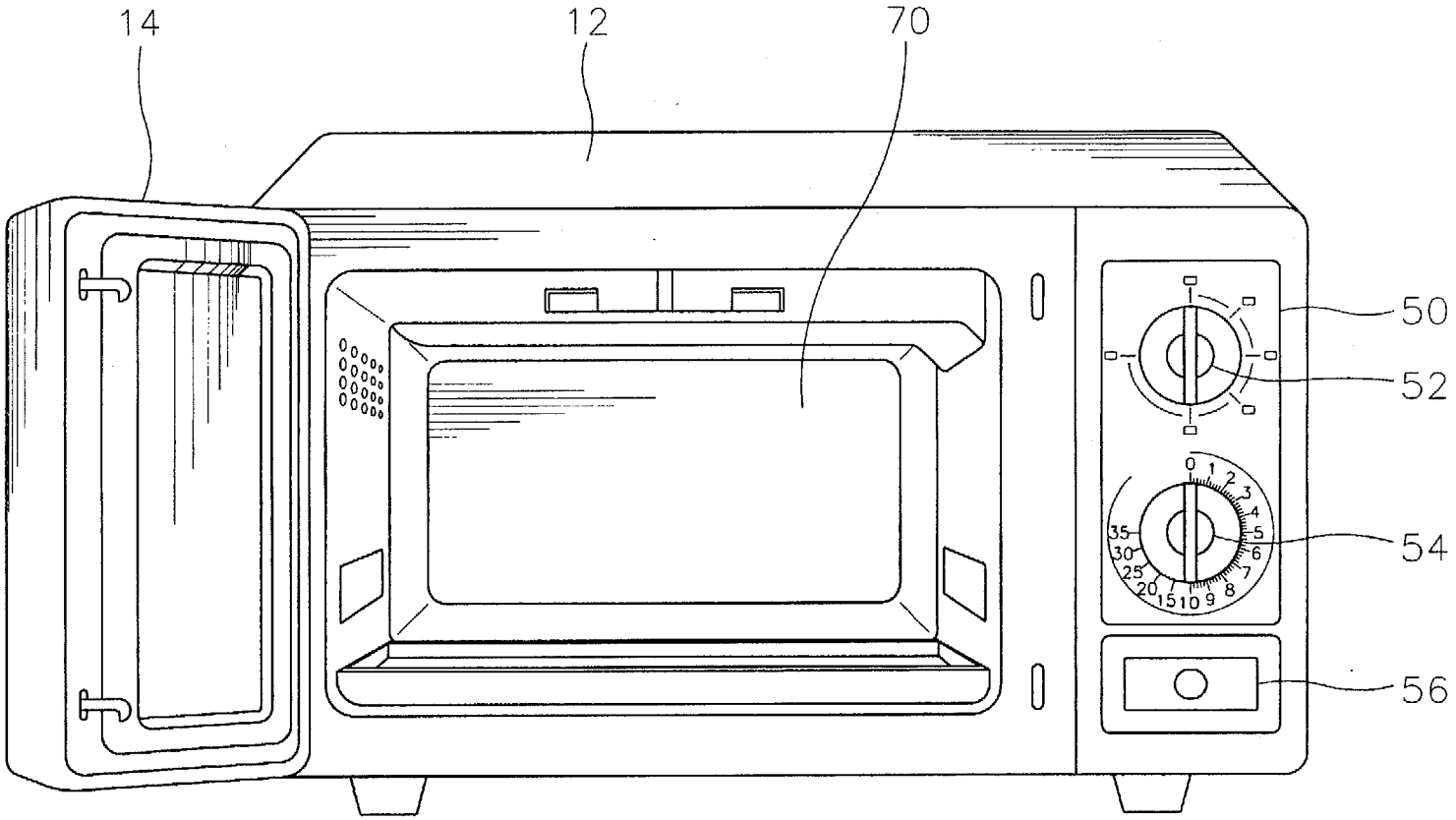
FIG. 9 (PRIOR ART)
FIG. 9 is a perspective view of the conventional microwave oven.
Figure 10:
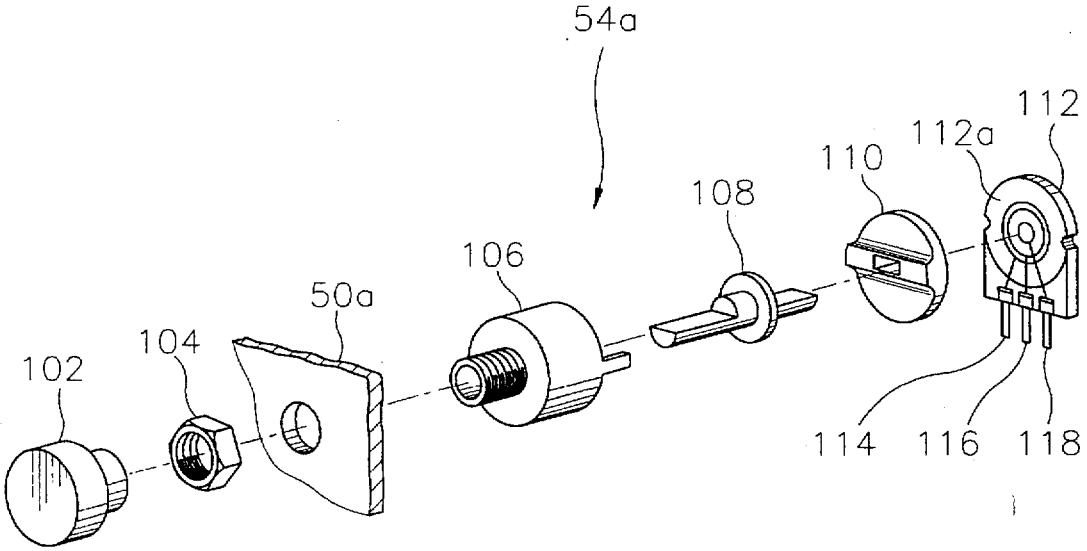
FIG. 10 (PRIOR ART)
FIG. 10 is an exploded perspective view of the conventional electronic control timer.
Figure 11:
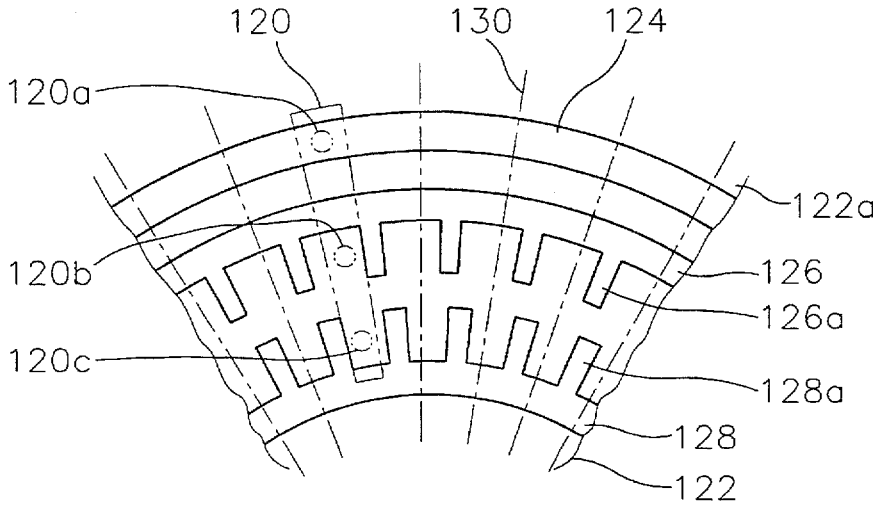
FIG. 11 (PRIOR ART)
FIG. 11 is an segmentary view of a switch substrate as shown in FIG. 10.

FIG. 7 illustrates switch 240*a* in detail. Switch 240*a* is installed to a final position of first gear segment 232 in order to cover the cooking time which may be set by timer knob 102. Switch 242*a* includes a supporting bar 242, a conductive switch member 244 and a switch contact 246. Supporting bar 242 is fixed to timer panel 220. Switch member 244 is inwardly extended from supporting bar 242 in the radial direction. Switch contact 246 is attached to a lower side of switch member 244.

Switch 242*a* is activated by contacting with first arc section 248 during the total cooking period which is manually adjusted. That is, switch 242*a* generates a plurality of pulses by contacting with first arc section 248 in accordance with the rotation displacement of gear 230. At the end of the cooking period, switch 240 is non-activated by contacting with second arc section 248*a*.

Hereinbelow, the operation of electronic control timer 254 according to the second embodiment of the present invention having the above structure will be described.

Referring to FIGS. 6 and 7, when the user rotates timer knob 102 (referred to FIG. 1) in a clockwise direction, gear 230 is rotated in a clockwise direction. For example, if the user wants to set the cooking period of twenty minutes, the user rotates timer knob 102 until timer knob 102 reaches a corresponding notch mark on timer panel 220. Accordingly, gear 230 is rotated in a clockwise direction in accordance with the rotation displacement of timer knob 102. Switch 242*a* is brought into contact with first arc section 248 in accordance with the rotation displacement of gear 230 to generate pulse signals corresponding to the cooking period of twenty minutes.

The pulse signals generated from switch 240 are transmitted to the microprocessor (not shown) and gear driving device 250. The microprocessor operates microwave oven 100 based on the pulse signals supplied from switch 240. On the other hand, when the pulse signals are transmitted to gear driving device 250 which is electrically connected to switch 240, gear driving device 250 gradually rotates gear 230 in the count-clockwise direction and returns the gear 230 to the initial state thereof in accordance with the time lapse of the cooking period. The operation of gear driving device 250 which returns gear 230 to the initial state is the same as in the first embodiment. Therefore, detailed descriptions will be omitted.

As described above, the electronic control timer according to the preferred first embodiment of the present invention comprises the gear including the first and second gear segments which includes a plurality of gear teeth having a different gear pitch in order to correspond to a different cooking time unit, the switch which is activated when it is brought into contact with the first gear segment and is not activated when it is brought into contact with the second gear segment, and the gear driving device which is electrically connected to the switch and rotates the gear in the opposite direction to the initial rotating direction and returns the gear to the initial state thereof. On the other hand, the electronic control timer according to the preferred second embodiment of the present invention, except the gear driving device, comprises the first arc section having the prominence and depression-shaped conductive pattern and the second arc section which are continuously formed on one side surface of the single gear having the first and second gear segment, and the switch which is activated when it is brought into contact with the first gear segment and is not activated when it is brought into contact with the second gear segment.

The electronic control timer of the present invention having the above structure can set a total cooking period by various time units, and has a simple internal structure and a low manufacturing cost.

While the present invention has been particularly shown and described with reference to a particular embodiment thereof, it will be understood by those skilled in the art that various changes in form and details may be affected therein without departing from the spirit and scope of the invention as defined by the appended claims.

What is claimed is:

1. An electronic control timer for a microwave oven said electronic control timer comprising:

a gear having a first gear segment and a second gear segment which are continuously formed at a periphery of the gear in order to receive a driving force and to recover an initial state;

a switch for generating a pulse signal in accordance with a rotation displacement of said gear, said switch being installed adjacently to said gear, being activated during a total cooking period and not being activated when the total cooking period is ended; and a gear driving means for generating the driving force, said gear driving means being activated to generate the driving force when said switch is activated, said gear driving means being electrically connected to said switch, said gear driving means including a U-laid-shaped core, a coil which is wound around said core and a circular rotator which is disposed to a central region of an opening of said core.

2. An electronic control timer for a microwave oven as claimed in claim 1, wherein said first gear segment includes a plurality of teeth having first and second gear teeth, and said second gear segment has a toothless shape.

3. An electronic control timer for a microwave oven as claimed in claim 2, wherein said, first gear teeth has a first gear pitch corresponding to a first time unit and a second gear pitch corresponding to a second time unit.

4. An electronic control timer for a microwave oven as claimed in claim 3, wherein the first gear pitch and the second gear pitch are different from each other.

5. An electronic control timer for a microwave oven as claimed in claim 1, wherein said switch is brought into contact with said first gear segment during the total cooking period and is brought into contact with said second gear segment when the total cooking period is ended.

6. An electronic control timer for a microwave oven as claimed in claim 5, wherein said switch is a micro switch having a snap action mechanism.

7. An electronic control timer for a microwave oven as claimed in claim 1, wherein said rotator includes a circular head, a permanent magnet which is installed to a central region of said head, a plurality of rotating members which are installed to a periphery of said head in a symetrical manner in order to be engaged with said first gear segment, and an extension which is downwardly extended from the central region of said head.

8. An electronic control timer for a microwave oven as claimed in claim 7, wherein said core and said coil are activated by the pulse signal which is transmitted from said switch when said switch is activated so that said core and said coil form an electro magnet, said rotator is rotated by an electromagnetic interaction between said rotator and the electro magnet, and said rotating members are rotated in an opposite direction to an initial rotating direction of said gear in accordance with the rotation of said rotator, are engaged with said first gear segment, gradually rotate said gear in the opposite direction and return said gear to the initial state.

9. An electronic control timer for a microwave oven as claimed in claim 7, wherein said extension is inserted into a rotator receiving portion formed at a timer panel of the microwave oven, and said extension includes a plurality of reverse rotation preventing teeth for preventing a rotating of said rotator in an opposite direction to an initial rotating direction of said gear.

10. An electronic control timer for a microwave oven as claimed in claim 9, wherein said rotator receiving portion includes a protrusion which is engaged with said reverse rotation preventing teeth and an elastic member for elastically supporting said protrusion.

11. An electronic control timer for a microwave oven as claimed in claim 9, wherein said reverse rotation preventing teeth are formed at a periphery of said extension, and sharply protrude in the opposite direction.

12. An electronic control timer for a microwave oven said electronic control timer comprising:

a gear having a first gear segment and a second gear segment which are continuously formed at a periphery of the gear in order to receive a driving force and to recover an initial state;

a switch for generating a pulse signal in accordance with a rotation displacement of said gear, said switch being installed adjacently to said gear, being activated during a total cooking period and not being activated when the total cooking period is ended;

a gear driving means for generating the driving force, said gear driving means being activated to generate the driving force when said switch is activated; and a first arc section and a second arc section for setting the total cooking period, said switch is brought into contact with said first arc section during the total cooking period and is brought into contact with said second arc section when the total cooking period is ended.

13. An electronic control timer for a microwave oven as claimed in claim 12, wherein said first arc section includes a prominence-and-depression-shaped conductive pattern and the second arc section has a patternless shape.

14. An electronic control timer for a microwave oven as claimed in claim 13, wherein said first arc section and said second arc section are continuously formed on an side of said gear so that said first arc section and said second arc section radially correspond to said first gear segment and said second gear segment, respectively.

15. An electronic control timer for a microwave oven, said electronic control timer comprising:

a gear having a first gear segment and a second gear segment which are continuously formed at a periphery of the gear in order to receive a driving force and to recover an initial state, said first gear segment includes a plurality of teeth having first and second gear teeth, the first gear teeth have a first gear pitch corresponding to a first time unit, the second gear teeth have a second gear pitch corresponding to a second time unit, said second gear segment has a toothless shape, the first gear pitch and the second gear pitch are different from each other;

a switch for generating a pulse signal in accordance with a rotation displacement of said gear, said switch being installed adjacently to said gear, being activated by contacting with said first gear segment during the total cooking period and not being activated by contacting with said second gear segment when the total cooking period is ended; and a gear driving means for generating the driving force, said gear driving means being activated to generate the driving force when said switch is activated, said gear driving means is electrically connected to said switch, and includes a U-laid-shaped core, a coil which is wound around said core and a circular rotator which is disposed to a central region of an opening of said core, said rotator includes a circular head, a permanent magnet which is installed to a central region of said head, a plurality of rotating members which are installed to a periphery of said head in a symetrical manner in order to be engaged with said first gear segment, and an extension which is downwardly extended from the central region of said head, said core and said coil are activated by the pulse signal which is transmitted from said switch when said switch is activated so that said core and said coil form an electro magnet, said rotator is rotated by an electromagnetic interaction between said rotator and the electro magnet, and said rotating members are rotated in an opposite direction to an initial rotating direction of said gear in accordance with the rotation of said rotator, are engaged with said first gear segment, gradually rotate said gear in the opposite direction and return said gear to the initial state, said extension is inserted into a rotator receiving portion formed at a timer panel of the microwave oven, and said extension includes a plurality of reverse rotation preventing teeth for preventing a rotating of said rotator in the opposite direction, said rotator receiving portion includes a protrusion which is engaged with said reverse rotation preventing teeth and an elastic member for elastically supporting said protrusion, said reverse rotation preventing teeth are formed at a periphery of said extension, and sharply protrude in the opposite direction.

16. An electronic control timer for a microwave oven as claimed in claim 15, wherein said switch comprises a micro switch having a snap action mechanism.

17. An electronic control timer for a microwave oven, said electronic control timer comprising:

a gear having a first gear segment and a second gear segment which are continuously formed at a periphery of the gear in order to receive a driving force and to recover an initial state, and having a first arc section and a second arc section for setting the total cooking period, said first arc section includes a prominence-and-depression-shaped conductive pattern and the second arc section has a patternless shape, said first arc section and said second arc section are continuously formed on an side of said gear so that said first arc section and said second arc section radially correspond to said first gear segment and said second gear segment, respectively, said first gear segment includes a plurality of teeth having first and second gear teeth, the first gear teeth have a first gear pitch corresponding to a first time unit, the second gear teeth have a second gear pitch corresponding to a second time unit, said second gear segment has a toothless shape, the first gear pitch and the second gear pitch are different from each other;

a switch for generating a pulse signal in accordance with a rotation displacement of said gear, said switch being installed adjacently to said gear, being activated by contacting with said first arc section during the total cooking period and not being activated by contacting with said second arc section when the total cooking period is ended; and a gear driving means for generating the driving force, said gear driving means being activated to generate the driving force when said switch is activated, said gear driving means is electrically connected to said switch, and includes a U-laid-shaped core, a coil which is wound around said core and a circular rotator which is disposed to a central region of an opening of said core, said rotator includes a circular head, a permanent magnet which is installed to a central region of said head, a plurality of rotating members which are installed to a periphery of said head in a symetrical manner in order to be engaged with said first gear segment, and an extension which is downwardly extended from the central region of said head, said core and said coil are activated by the pulse signal which is transmitted from said switch when said switch is activated so that said core and said coil form an electro magnet, said rotator is rotated by an electromagnetic interaction between said rotator and the electro magnet, and said rotating members are rotated in an opposite direction to an initial rotating direction of said gear in accordance with the rotation of said rotator, are engaged with said first gear segment, gradually rotate said gear in the opposite direction and return said gear to the initial state, said extension is inserted into a rotator receiving portion formed at a timer panel of the microwave oven, and said extension includes a plurality of reverse rotation preventing teeth for preventing a rotating of said rotator in the opposite direction, said rotator receiving portion includes a protrusion which is engaged with said reverse rotation preventing teeth and an elastic member for elastically supporting said protrusion, said reverse rotation preventing teeth are formed at a periphery of said extension, and sharply protrude in the opposite direction.

18. An electronic control timer for a microwave oven as claimed in claim 17, wherein said switch comprises a micro switch having a snap action mechanism.

* * * * *